US007299855B2

(12) United States Patent
Thomason et al.

(10) Patent No.: US 7,299,855 B2
(45) Date of Patent: Nov. 27, 2007

(54) DIE CASTING RECIPROCATOR SAFETY BAR

(75) Inventors: David R. Thomason, Harrison, AR (US); David E. Bumpus, Brookline, NH (US); Danny S. Alford, Harrison, AR (US); Olen L. Marshall, Harrison, AR (US)

(73) Assignee: L&P Property Management Company, South Gate, CA (US)

( * ) Notice: Subject to any disclaimer, the term of this patent is extended or adjusted under 35 U.S.C. 154(b) by 496 days.

(21) Appl. No.: 10/886,780

(22) Filed: Jul. 8, 2004

(65) Prior Publication Data

US 2006/0005938 A1 Jan. 12, 2006

(51) Int. Cl.
*B22D 17/32* (2006.01)

(52) U.S. Cl. ..... 164/153; 164/267; 164/312; 164/154.1

(58) Field of Classification Search ..... 164/153, 164/267, 312, 154.1, 113, 72
See application file for complete search history.

(56) References Cited

U.S. PATENT DOCUMENTS 4,214,704 A * 7/1980 Nagai ..... 239/753
5,560,466 A * 10/1996 Folk et al. ..... 192/130

* cited by examiner

*Primary Examiner*—Jonathan Johnson
*Assistant Examiner*—I.-H. Lin
(74) *Attorney, Agent, or Firm*—Conley Rose, P.C.; Kristin Jordan Harkins

(57) ABSTRACT

An automated reciprocator for applying lubricant to the cavity of a die casting system having a safety bar for preventing the reciprocator from injuring a person or damaging equipment which may be present in the reciprocator travel path. The safety bar is movably carried on the lower side of the reciprocator and includes a sensor to detect relative movement between the safety bar and the reciprocator. The proximity sensor is coupled to a control system. If the safety bar contacts an object as the reciprocator is moving down, the sensor signals the control system and the reciprocator is stopped.

9 Claims, 2 Drawing Sheets

DIE CASTING RECIPROCATOR SAFETY BAR

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

FIELD OF THE INVENTION

The present invention relates to automated die casting systems having reciprocating spray systems, and more particularly to a reciprocating spray system including a safety bar preventing the reciprocator from injuring an operator of the die casting system.

BACKGROUND OF THE INVENTION

Die casting is a manufacturing process for producing accurately dimensioned, sharply defined, smooth or textured-surface metal parts. A steel mold capable of producing tens of thousands of castings in rapid succession is made in at least two sections to permit removal of castings. These sections are mounted securely in a machine and are arranged so that one is stationary (fixed die half) while the other is moveable (injector die half). To begin the casting cycle, the die cavity is coated with a lubricant or mold release material. Then, the two die halves are clamped tightly together by the die casting machine. Molten metal is injected into the die cavity where it solidifies quickly. The die halves are drawn apart and the casting is ejected.

Die casting cycle times vary from less than one second for small components weighing less than one ounce, to thirty seconds or more for a casting of several pounds or more. Dies are filled quickly (normally between five and forty milliseconds) and metal is injected at high pressures (1,500 to over 4,500 psi). Nevertheless, modern automation technology gives close control over these values, thus producing castings with fine detail, close tolerances and high strength.

The die casting process has been automated to improve quality control, speed and safety. For example, safety interlocks prevent filling a mold with a shot of molten metal unless the mold is securely clamped shut and an outer door of a system enclosure is closed to protect the system operator. When a mold is opened after a casting cycle and the finished part is removed, an automated reciprocating sprayer or reciprocator may move down between the open die halves to spray on a lubricant on the die cavity. As the reciprocator returns to its rest position, it blows high pressure air on the mold cavity to remove excess lubricant and dry the cavity faces. The reciprocator is typically activated by the operator after opening the safety door to remove the finished die casting. Regulations have been proposed to require a safety door interlock with the reciprocator to insure that the reciprocator cannot move down when the door is open because the operator may still be in the casting enclosure. However, such an interlock arrangement would add a significant amount of time to the casting cycle time, thereby reducing the productivity of the die casting system.

SUMMARY OF THE INVENTION

The present invention provides an automated reciprocator having a safety bar sized and positioned to contact any object in the downward travel path of the reciprocator bar. The safety bar is movably attached to the reciprocator so that upon contact with any object in the path, the safety bar moves relative to the reciprocator. At least one relative movement sensor is coupled between the safety bar and the reciprocator and provides a signal to a control system to interrupt the reciprocator cycle if the safety bar encounters an object.

DETAILED DESCRIPTION OF THE PREFERRED EMBODIMENTS

Figure 1:
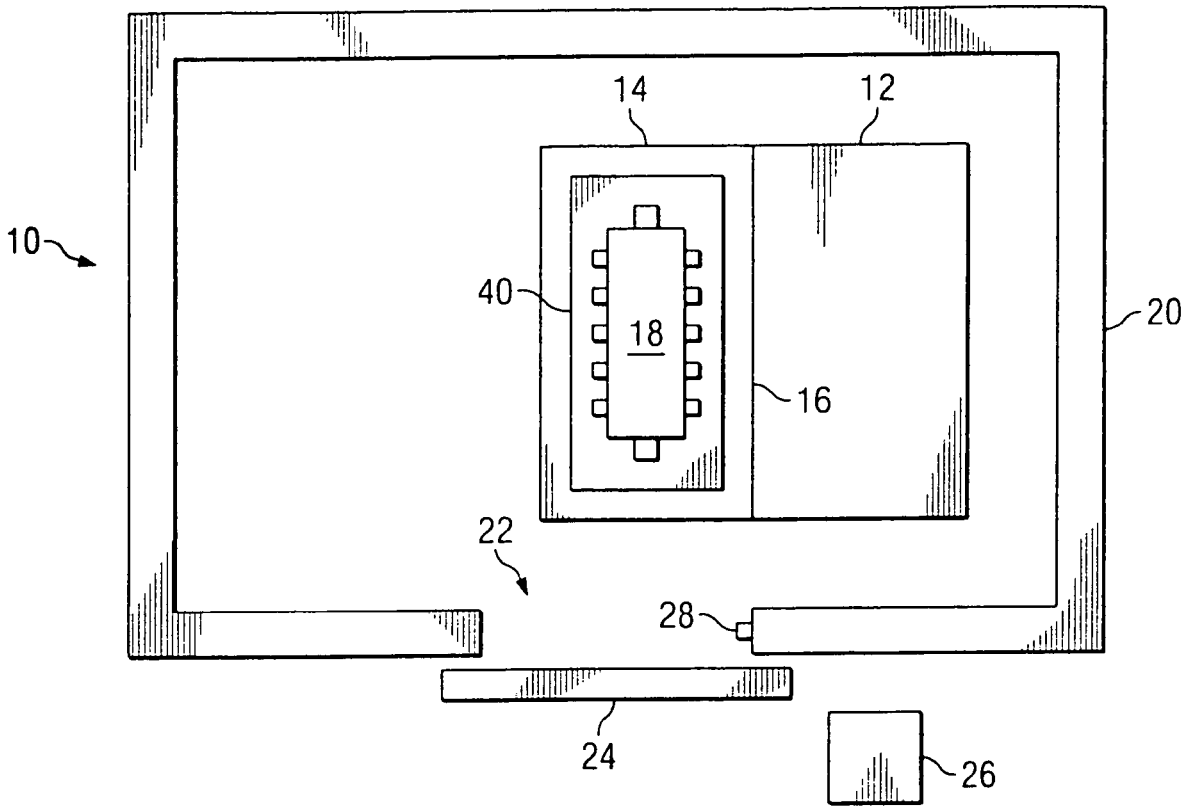
FIG. 1 is a simplified plan view of a typical die casting system according to the present invention.

FIG. 1 is a simplified plan view of a typical die casting system 10 according to the present invention. A stationary or fixed die half 12 and a moveable or injector die half 14 are shown meeting at a parting line 16. Above the fixed die half 12 is shown a reciprocator 18, described in more detail below. The die or mold 12, 14 is surrounded by an enclosure 20 having an entrance 22. A door 24 is provided across entrance 22. A system control panel 26 is typically located near the door 24. A reciprocator activating switch or button 28 may be provided on the enclosure 20, just inside the door 24.

Figure 2:
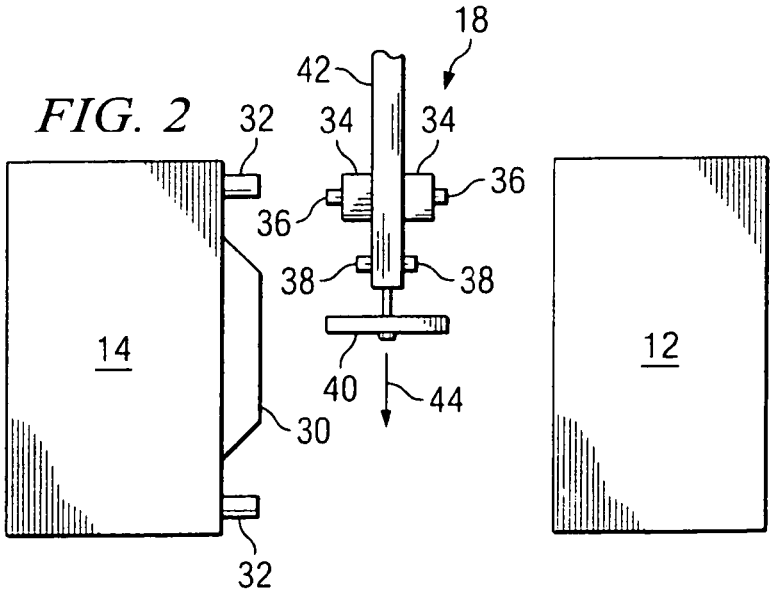
FIG. 2 is an elevation view of an open mold illustrating operation of a reciprocator according to the present invention.

FIG. 2 is an elevation view of the mold 12, 14 shown in its open position with the reciprocator 18 beginning its operating cycle. A die face 30 of moveable die half 14 is visible in FIG. 2. Guide pins 32 are provided to insure proper alignment of the mold 12, 14, when the pins 32 engage corresponding holes in the fixed die half 12. The reciprocator 18 includes a lubricant sprayer 34 with nozzles 36, air nozzles 38, and a safety bar 40 all carried on a moveable frame 42. After the die halves 12 and 14 have opened as illustrated in FIG. 2, and a finished part has been removed, the reciprocator 18 moves downward as indicated by the arrow 44. While moving downward, lubricant, which may be a mold release compound carried in water, is sprayed through the nozzles 36 onto the faces of the die cavity. After the reciprocator 18 reaches the bottom of the mold 12, 14, the lubricant sprayer 34 is turned off and high pressure air is supplied to nozzles 38, preferably through the frame 42. The reciprocator is then move upward to a rest or storage position above the mold 12, 14 as indicated in FIG. 1. During the upward movement, the air from nozzles 38 blows off any excess lubricant and dries the faces of the mold cavity, e.g. 30.

Figure 3:
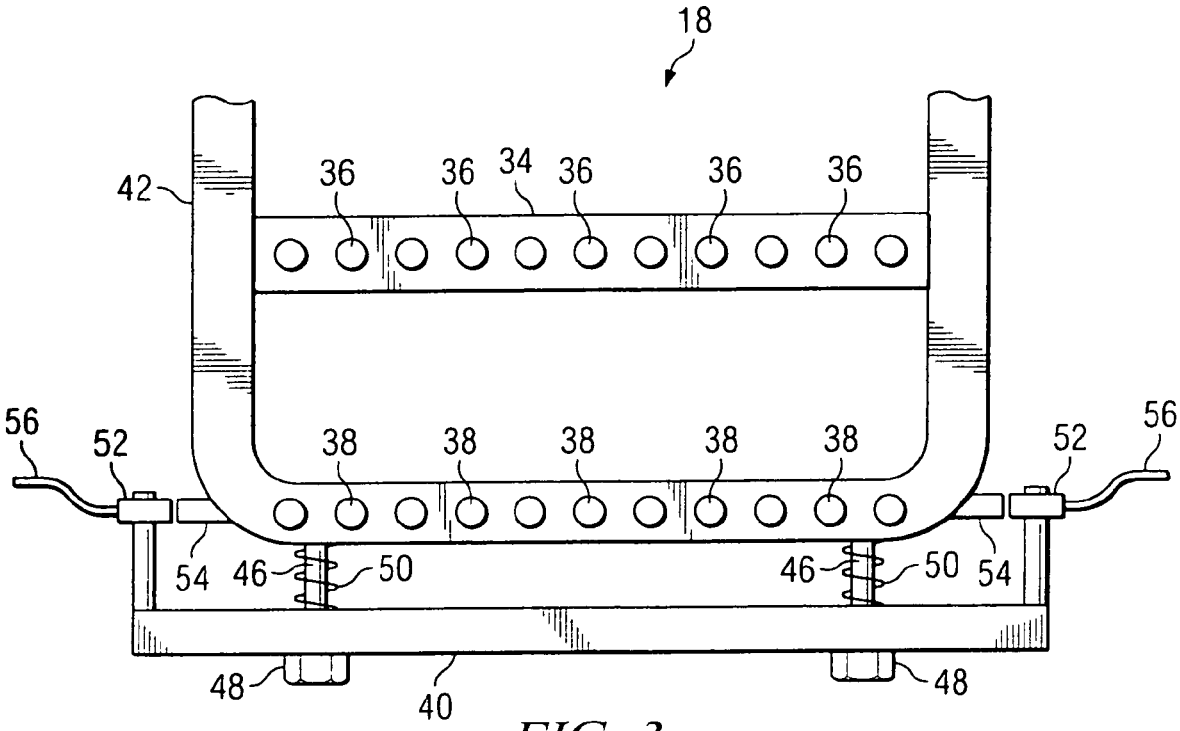
FIG. 3 is a side view of a die casting reciprocator showing details of a safety bar according to the present invention.

FIG. 3 provides a side view of a die casting reciprocator 18 showing more details of a safety bar 40 according to the present invention. Parts shown in FIGS. 1 and 2 are given the same reference numbers in FIG. 3. The frame 42 of the reciprocator 18 may be made of square cross section hollow tubing which may be used to convey high pressure air to the blow off nozzles 38. Suitable hoses may be provided to convey lubricant to the sprayer 34 and through it to the sprayer nozzles 36. Conventional automated or robotic systems may be provided for lowering and raising the frame 42 as needed.

As shown in the figures, the safety bar 40 is a simple rectangular element having length and width dimensions at least as large as the plan view dimensions of the reciprocator as shown in FIG. 1. The safety bar 40 may be a solid sheet of a suitable material or may be made from a framework of individual parts leaving some open spaces. It is preferred that the all edges of the safety bar be continuous so that it moves through or sweeps out a space having plan view length and width dimensions at least as large as the space through which the reciprocator 18 moves in its downward travel.

The safety bar 40 is movably supported from the lower side of the reciprocator 18, e.g. by a slidable connector comprising a pair of bolts 46 attached at their upper ends to the frame 42. The safety bar 40 may have clearance holes for receiving the bolts 46. A nut 48 or other retainer means may be attached to the lower end of each bolt 46 below the safety bar 40 to suspend the safety bar 40 at a selected distance below the reciprocator 18. While gravity tends to hold the safety bar 40 in its lowermost position on the bolts 46, it is preferred to provide springs 50 around the bolts 46 to further urge the safety bar 40 into this position.

In this embodiment, a proximity sensor 52 is carried on each end of the safety bar 40, to detect upward movement of the safety bar 40 relative to the reciprocator 18. The proximity sensor may be an inductive sensor sold by Turck, Inc. of Minneapolis, Minn. under the Part Number Bi 2-EG08K-AP6X-V1131 and ID Number S4669450. A metal extension 54 may be provided on the frame 42 proximate each of the proximity sensors 52 when the safety bar 40 is in its lowermost position. The hall effect sensors 52 provide a closed circuit between its wire leads 56 when they are near a metal object and an open circuit between leads 56 when they move away from the metal object. In this embodiment, the leads 56 of both sensors 52 are connected in series and the circuit is connected to an input of the control system 26.

As noted above, in normal operation of the die casting system of FIGS. 1 and 2, the operator prefers to activate the reciprocator 18 cycle as he enters the door 22 to remove the just cast part. The reciprocator would then begin it downward travel before the operator can completely remove the finished part and exit the enclosure 20. During normal operations there is sufficient time for the operator to exit. By following this procedure, a finished part, e.g. a gas grill top or bottom housing, may be cast in a 25 second cycle time. If the operator is required to exit and close the door 24 before the reciprocator can start its cycle, at least 5 more seconds will be added to the cycle time, reducing system productivity by about twenty percent.

With the system of the present invention, the operator may activate the reciprocator as he enters the enclosure 20 to remove a finished part without danger of being injured by contact with the reciprocator as it cycles. If for any reason the operator does not exit the enclosure 20, but remains in the travel path of the reciprocator 18, the safety bar 40 will contact the operator before any other part of the reciprocator can reach the operator. With only slight force on the safety bar 40, it will move upward relative to the reciprocator 18 and one or both proximity detectors 52 will move away from its corresponding post 54. The circuit in one or both detectors 52 will open and the control system 26 will instantly stop movement of the reciprocator bar 18 and stop the flow of lubricant through the nozzles 36. If desired, the control system may be programmed to return the reciprocator to its uppermost or rest position above the mold 12, 14. In a preferred embodiment, the control system 26 is programmed to not allow the operator to restart the reciprocator by pushing the button 28, but to instead require the operator to physically go to the control system 26 and reset the reciprocator.

While a particular proximity sensor, a hall effect device, was used in the preferred embodiment, it is apparent that many other devices could be substituted. For example, magnetic relays such as those used on home security systems could be used. The metal extensions 54 could be magnets positioned to close such relays carried on the safety bar 40. Various optical sensors may also be used. Mechanically operated switches or relays may be coupled between the safety bar 40 and the reciprocator 18 to close or open a circuit in response to movement of the safety bar 40 relative to the reciprocator 18. In the preferred embodiment, the proximity sensor is carried on the safety bar 40 and the material being sensed, e.g. bars 54, is carried on the reciprocator frame 42. It is apparent that the sensors 52 could be mounted on the frame 42 and the material being sensed, e.g. a magnet, could be carried on the safety bar 40.

While the bolts 46 are shown as fixed to the frame 42 and slidably coupled to the safety bar 40, it is apparent that the bolts could be fixed to the safety bar 40 and slidably coupled to the reciprocator 18.

While the present invention has been described in terms of preventing injury to the operator of the die casting system, it is also useful for preventing property damage. For example, there could be a malfunction of the system which results in the movable die half 14 failing to move to its fully open position. In that case, the reciprocator may collide with the die half 14 damaging the die and/or the reciprocator itself. Damage to either would be expensive to repair and may result in extended downtime for the die casting system. The present invention reduces the chances of such system damage by stopping the reciprocator if it contacts any other part of the die casting system as it cycles downward.

While the present invention has been illustrated and described with reference to particular components and methods of operation, it is apparent that various substitution of components and changes in methods of operation can be made within the scope of the present invention as defined by the appended claims.

What we claim as our invention is:

1. A die casting system, comprising:

an automated reciprocator adapted for moving between two die halves and applying a fluid to the dies, a safety bar carried on the reciprocator, the bar positioned to move ahead of the reciprocator, and a sensor for providing a signal when the safety bar contacts another object wherein the system further comprising a slidable connector supporting the safety bar from a lower surface of the reciprocator, the connector limiting the maximum distance between the safety bar and the reciprocator, but allowing the safety bar to move toward the reciprocator.

2. A die casting system according to claim 1, further comprising:

a control system coupled to the sensor and to the reciprocator.

3. A die casting system according to claim 2, wherein the control system stops movement of the reciprocator in response to a signal from the sensor.

4. A die casting system according to claim 3, wherein the control system stops the reciprocator from applying fluid to the dies in response to a signal from the sensor.

5. A die casting system according to claim 2, wherein the control system returns the reciprocator to a rest position in response to a signal from the sensor.

6. A die casting system according to claim 1, wherein the safety bar has length and width dimensions at least as large as the length and width dimensions of the reciprocator.

7. A die casting system according to claim 1, wherein the safety bar has length and width dimensions selected to pass through at least the same space as the reciprocator.

8. A die casting system according to claim 1, wherein the sensor is a proximity sensor detecting the position of the safety bar relative to the reciprocator.

9. A die casting system according to claim 8, wherein the proximity sensor is a hall effect device.

* * * * *